United States Patent [19]

van de Plassche et al.

[11] Patent Number: 4,567,426

[45] Date of Patent: Jan. 28, 1986

[54] CURRENT STABILIZER WITH STARTING CIRCUIT

[75] Inventors: Rudy J. van de Plassche, Sunnyvale, Calif.; Peter J. M. Sijbers, Eindhoven, Netherlands

[73] Assignee: U.S. Philips Corporation, New York, N.Y.

[21] Appl. No.: 595,062

[22] Filed: Mar. 30, 1984

[30] Foreign Application Priority Data

Apr. 5, 1983 [NL] Netherlands ..... 8301186

[51] Int. Cl.[4] ..... G05F 3/16

[52] U.S. Cl. ..... 323/315; 323/312; 323/901

[58] Field of Search ..... 310/312, 313, 314, 315, 310/316, 901

[56] References Cited

U.S. PATENT DOCUMENTS 4,185,236 1/1980 van de Plassche et al. ..... 323/316
4,282,477 8/1981 Ahmed ..... 323/312
4,399,399 8/1983 Joseph ..... 323/315

FOREIGN PATENT DOCUMENTS 2140692 5/1972 Fed. Rep. of Germany ..... 323/315
2157756 6/1972 Fed. Rep. of Germany ..... 323/315
3027761 2/1981 Fed. Rep. of Germany ..... 323/315

*Primary Examiner*—Peter S. Wong
*Assistant Examiner*—D. L. Rebsch
*Attorney, Agent, or Firm*—Robert T. Mayer; Steven R. Biren

[57] ABSTRACT

Two current circuits are between two common terminals ($+V_B$ and $-V_B$). The ratio between the currents in the two current circuits is defined by a first current-dividing circuit, and the absolute values of these currents are defined by means of a second current-dividing circuit, in particular a resistor in this second current-dividing circuit. In order to ensure that the current-stabilizing assumes the proper state upon activation, a first current-supply circuit is coupled to the input of the second current-dividing circuit, which current-supply circuit comprises the series arrangement of a resistor and a transistor arranged as a diode, and a second current-supply circuit is coupled to the output of the current-dividing circuit, which second current-supply circuit includes a transistor whose base is connected in common with that of the transistor of the first current-supply circuit.

4 Claims, 3 Drawing Figures

CURRENT STABILIZER WITH STARTING CIRCUIT

BACKGROUND OF THE INVENTION

The invention relates to a current stabilizing arrangement including a first and a second current path between a first and a second common terminal, a first current-dividing circuit having transistors of a first conductivity type and having an input circuit with a low input impedance and an output circuit with a high output impedance, and a second current-dividing circuit comprising transistors of a second conductivity type and also having an input circuit with a low input impedance and an output circuit with a high output impedance, the first current-dividing circuit defining the ratio between the currents flowing in the two current paths and the second current-dividing circuit defining the absolute values of the currents flowing in the two current paths by means of a semiconductor junction connected in parallel with the series arrangement of a semiconductor junction and a first resistor, which current stabilizer also includes means for starting the current-stabilizing arrangement.

Herein, a current-stabilizing arrangement in general is to be understood to mean a circuit arrangement in which the ratio between the currents in the input and the output current path is defined unambiguously by a parallel arrangement of semiconductor junctions, whether or not in combination with resistors.

Such a current-stabilizing arrangement is disclosed in, for example, German patent application No. 2,140,692, which has been laid open to public inspection. A problem associated with such current-stabilizing arrangements is that, apart from a stable state in which the desired currents flow, they also have a stable state in which the currents are zero. This means that these current-stabilizing arrangements require an additional starting circuit which ensures that when the power supply is switched on the arrangement occupies the desired stable state in which the currents are not zero.

In the current-stabilizing arrangement in German patent application No. 2,140,692, this starting circuit includes the series arrangement of a resistor and two diodes, poled in the forward direction between the two power-supply terminals, and a third diode which connects the junction point of the resistor and one of the diodes to a suitable connection point of the current-stabilizing arrangement. When the power supply is switched on, a current will flow in the series arrangement of the resistor and the diodes, so that such a voltage appears across the series arrangement of the two diodes that the third diode is biassed in the forward direction and, via this third diode, a starting current is supplied to the connection point, owing to which a current will flow in the current-stabilizing arrangement and the arrangement assumes the desired stable state. The connection point has been selected so that when the current-stabilizing arrangement has assumed the desired stable state the third diode is biassed in the reverse direction and is consequently cut off.

The use of such a starting circuit has the disadvantage that during starting the voltage across the two diodes poled in the forward direction also appears across the series arrangement of one diode and two base-emitter junctions which is arranged in parallel with said two diodes, i.e. across three base-emitter junctions in total, so that the starting current, which is the current through these base-emitter junctions, will be very small. Therefore, starting of the arrangement is not always guaranteed. Moreover, the total current consumed by the stabilizing arrangement is not stabilized because the starting circuit consumes a certain non-stabilized current.

In the current-stabilizing arrangement described in German patent application No. 2,157,756, the starting circuit comprises a leakage current source which supplies a leakage current to one of the two current paths of the arrangement in order to obtain the desired state with non-zero currents during switching on. Such a starting circuit has the disadvantage that after the arrangement has been started the leakage current keeps flowing in one of the two current paths and thereby affects the operation of the current stabilizer. In order to minimize this effect the leakage current must be substantially smaller than the stabilized currents in the two current paths. However, if the stabilizer current is small, the leakage current becomes impracticably small. The use of a leakage-current source also has the disadvantage that, due to the temperature dependence of the leakage current at low temperatures, the leakage current becomes so small that it is no longer capable of starting the arrangement.

SUMMARY OF THE INVENTION

It is an object of the invention to provide a current-stabilizing arrangement with a starting circuit which does not have these drawbacks. To this end the invention is characterized in that the means comprise a first current-supply circuit which supplies a current to the input circuit of the second current-dividing circuit and a second current-supply circuit which supplies a current to the output circuit of the second current-dividing circuit, the currents supplied by the first and the second current-supply circuit having a ratio which is equal to the ratio between the currents in the two current paths as defined by the first current-dividing circuit. This step in accordance with the invention ensures that both the input circuit and the output circuit of the second current-dividing circuit receive a starting current. Since the ratio between these starting currents is equal to the ratio between the currents in the two current paths as defined by the first current-dividing circuit, this will not affect the operation of the current-stabilizing arrangement. If the currents supplied by the current-supply circuits vary to the same extent, these variations are corrected by the first current-dividing circuit which defines the ratio between the currents in the two current paths. Moreover, the currents from the current-supply circuits need no longer be small relative to the stabilized currents in the two current paths, provided that the last-mentioned currents are larger than the currents from the current-supply circuits. The current-supply circuits also have the advantage that they can be integrated on a small surface area.

A current-stabilizing arrangement without a starting circuit is known per se from German patent application No. 3,027,761, which has been laid open to public inspection, which arrangement includes two current sources which are coupled to the input circuit and the output circuit of a current-dividing circuit and which each supply a current which is larger than the stabilized current in the two circuits. The input circuit and the output circuit of the current-dividing circuit are also connected to the input and the output of a current-mirror circuit which comprises transistors of the same conductivity type as the transistors of the current-dividing circuit. The current-dividing circuit receives the differences between the currents from the current sources and the stabilized currents in the input circuit and the output circuit of the current-dividing circuit. This means that the current circuits in this circuit arrangement do not serve as starting currents but as reference-current sources which in effect impress the stabilized currents on the current-dividing circuit. Moreover, the total current consumed by the current stabilizer is no longer stabilized due to the presence of the current sources.

A first embodiment is characterized in that the first current-supply circuit comprises the series arrangement of a transistor connected as a diode and a resistor, the resistor being coupled to the input circuit of the second current-dividing circuit, and the second current-supply circuit comprises a transistor whose base is coupled to the base of the transistor of the first current-supply circuit.

A second embodiment is characterized in that the first and the second current-supply circuit each comprise a transistor, which transistors have commoned bases which carry a reference voltage. It is advantageous if instead of these transistors one common transistor with a multiple collector is employed.

BRIEF DESCRIPTION OF THE DRAWING

The invention will now be described in more detail, by way of example, with reference to the accompanying drawing, in which.

DESCRIPTION OF THE PREFERRED EMBODIMENTS

Figure 1:
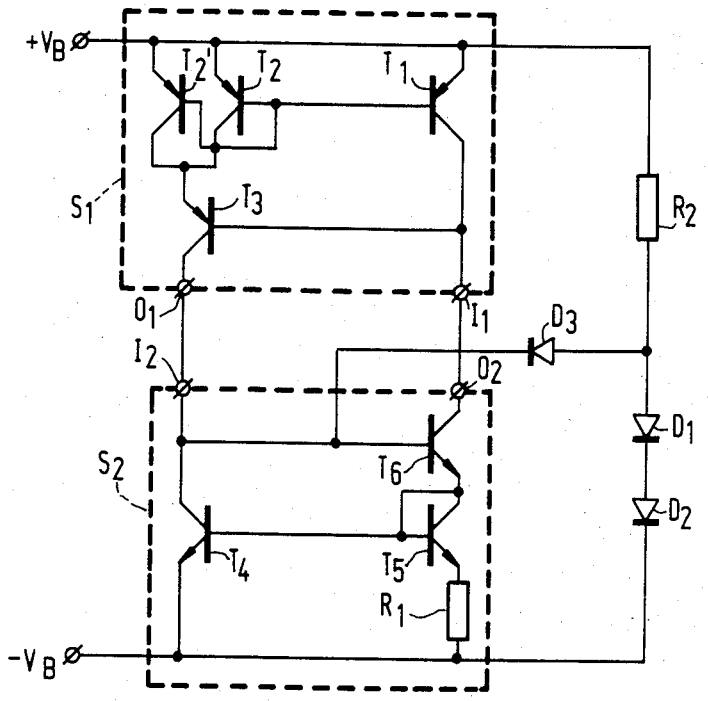
FIG. 1 PRIOR ART
FIG. 1 shows a known current-stabilizing arrangement.

The current-stabilizing arrangement known from the aforementioned German patent application No. 2,140,692 and shown in FIG. 1, includes a first current-dividing circuit $S_1$ with pnp-type transistors. This current-dividing circuit $S_1$ having two transistors $T_1$ and $T_2$ with parallel-connected base-emitter paths. However, transistor $T_2$ has a larger emitter area than transistor $T_1$, which is schematically represented by transistor $T_2'$ arranged in parallel with transistor $T_2$. A further pnp transistor $T_3$ has its base connected to the collector of transistor $T_1$, in series with transistors $T_2$ and $T_2'$, which are connected as diodes. The base of transistor $T_3$ constitutes the input terminal $I_1$ of the current-dividing circuit and has a low input impedance, while the collector of transistor $T_3$ constitutes the output terminal and has a high output impedance. Owing to the parallel arrangement of the base-emitter paths of the transistors $T_1$ and $T_2$ this first current-dividing circuit defines the ratio between the currents flowing at the input terminal $I_1$ and the output terminal $O_1$, this ratio being equal to the ratio between the effective emitter areas of the transistors $T_1$ and $T_2$.

The current-stabilizing arrangement also includes a second current-dividing circuit $S_2$ with npn transistors. This current-dividing circuit $S_2$ comprises a transistor $T_4$ whose base-emitter path is arranged in parallel with the series arrangement of a transistor $T_5$ connected as a diode and a resistor $R_1$. A transistor $T_6$ is connected in series with resistor $R_1$ and transistor $T_5$, the base of transistor $T_6$ being connected to the collector of transistor $T_4$ and constituting the low-impedance input $I_2$ of the second current-dividing circuit $S_2$, and the collector of said transistor $T_6$ constituting the high-impedance output $O_2$ of this current-dividing circuit $S_2$.

The input $I_2$ of the second current-dividing circuit $S_2$ is connected to the output $O_1$ of the first circuit $S_1$ and the output $O_2$ of the second current-dividing circuit $S_2$ is connected to the input $I_1$ of the first current-dividing circuit. The first current-dividing circuit $S_1$ defines the ratio between the currents in these connections between the inputs and the outputs of the two current-dividing circuits which form current paths between the two power supply terminals $+V_B$ and $-V_B$. As in the second current-dividing circuit $S_2$, this current ratio can exist only for one specific absolute value of these two currents, whose values are determined by the value of the resistor $R_1$ in combination with the current ratio, the absolute values of both currents are defined exactly and are substantially independent of the supply voltage.

The current-stabilizing arrangement thus formed also has a stable state in which the currents in the two current paths are zero. In order to preclude the occurrence of this stable state there is provided a starting circuit comprising the series arrangement of a resistor $R_2$ and two diodes $D_1$ and $D_2$ between the two power-supply terminals $+V_B$ and $-V_B$ and a diode $D_3$ which connects the junction point between the resistor $R_2$ and the diode $D_1$ to the base of transistor $T_6$ in the second current-dividing circuit $S_2$. Via this diode $D_3$ a current is injected into the base of transistor $T_6$ upon application of the supply voltage, so that the current-stabilizing arrangement is energized and assumes the desired stable state. When this is the case the diode $D_3$ is cut off, so that no current flows in this diode.

The Figure clearly shows that during starting the voltage across the diodes $D_1$ and $D_2$ also appears across the diode $D_3$ and the base-emitter junctions of transistors $T_4$ and $T_6$, so that the starting current will be very small. Hence, it is not certain that the arrangement will be started under all conditions. Moreover, the total current consumed by the current-stabilizing arrangement will not be stabilized due to the presence of this starting circuit, because the series arrangement of the resistor $R_2$ and diodes $D_1$ and $D_2$ carries a non-stabilized current. In addition, this starting circuit will always dissipate some extra power.

Figure 2:
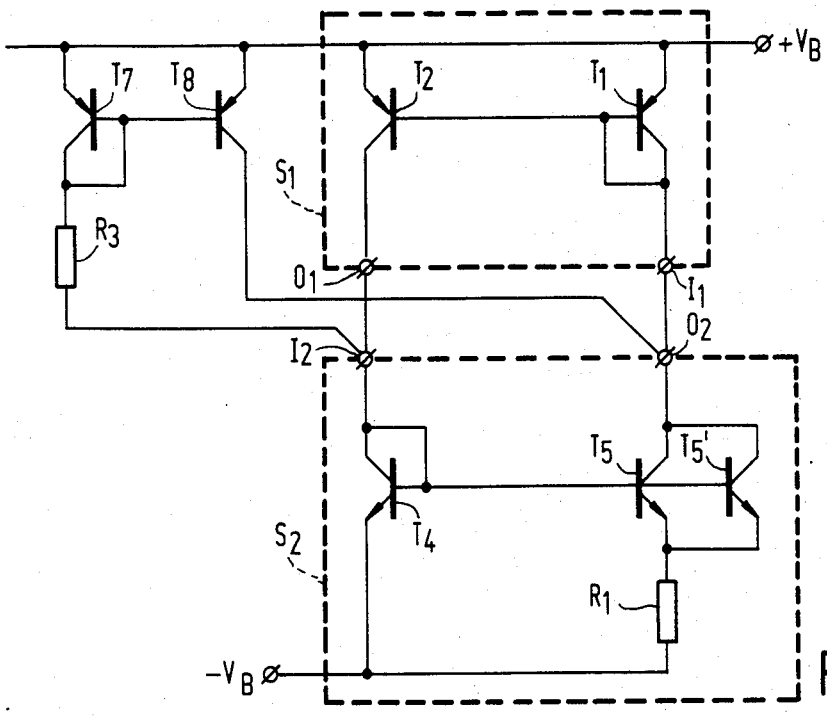
FIG. 2 shows a first current-stabilizing arrangement in accordance with the invention.

FIG. 2 shows a first current-stabilizing arrangement in accordance with the invention. The arrangement also comprises a first current-dividing circuit $S_1$ which now only comprises the transistors $T_1$ and $T_2$, the base of transistor $T_1$ being connected to its collector. The transistors $T_1$ and $T_2$ have equal emitter areas, so that the currents in input $I_1$ and output $O_1$ of this current-dividing circuit $S_1$ are necessarily equal. The second current-dividing circuit $S_2$ now comprises transistor $T_4$ connected as a diode, its base-emitter path being connected in parallel with the series arrangement of the base-emitter path of transistor $T_5$ and the resistor $R_1$. Since the current-dividing circuit $S_1$ feeds equal currents into both circuits, transistor $T_5$ in the second current-dividing circuit $S_2$ of the present current-stabilizing arrangement, as is known, must have a larger emitter area than transistor $T_4$, which is represented by means of a transistor $T_5'$ in parallel with transistor $T_5$. The input $I_2$ and the output $O_2$ of the second current-dividing circuit are again connected to the output $O_1$ and the input $I_1$, respectively, of the current-dividing circuit $S_1$. The input $I_2$ of the second current-dividing circuit $S_2$ is connected to the positive power-supply terminal $+V_B$ by a first current-supply circuit comprising the series arrangement of a resistor $R_3$ and a transistor $T_7$ connected as a diode. The output $O_2$ of the second current-dividing circuit $S_2$ is connected to the positive power-supply terminal $+V_B$ by a second current-supply circuit comprising a transistor $T_8$. The base of transistor $T_8$ is connected to the base of transistor $T_7$. Transistors $T_7$ and $T_8$ have equal emitter areas, so that the currents supplied by the first and second current-supply circuits are equal.

The arrangement is started as follows by the currents from the first and the second current-supply circuit. When a power-supply voltage which is higher than substantially two base-emitter voltages is applied, a current will flow through the resistor $R_3$ and hence through the input circuit of the second current-dividing circuit $S_2$, which current produces a certain voltage across the base-emitter junction of transistor $T_4$. This voltage appears also across the series arrangement of the base-emitter path of transistor $T_5$ and the resistor $R_1$. Initially, the voltage across resistor $R_1$ will be much smaller than the voltage across the base-emitter path of transistor $T_5$, so that almost the entire base-emitter voltage of transistor $T_4$ appears across the base-emitter path of transistor $T_5$. Since the emitter area of transistor $T_5$ is larger than that of transistor $T_4$ the collector current of transistor $T_5$ will be larger than that of transistor $T_4$. Owing to the commonly-connected bases of transistors $T_7$ and $T_8$ the collector current of transistor $T_8$ will be equal to the current through resistor $R_3$. The difference between the collector currents of the transistors $T_5$ and $T_8$ forms the collector current of transistor $T_1$. Owing to the current-mirror action this current flows also in the collector of transistor $T_2$ and is added to the current through transistor $T_4$. In this way the current through transistors $T_4$ and $T_5$ will increase until the stabilized current flows through these two transistors, the absolute value of this current being determined by the ratio between the emitter areas of transistors $T_5$ and $T_4$ and the resistance value of the resistor $R_1$. In the stabilized state the stabilized current in the input circuit and the output circuit of the current-dividing circuit $S_2$ is equal to the sum of the current from the relevant current-supply circuit and the current from the relevant circuit of the current-dividing circuit $S_1$. Since equal currents are applied to the input circuit and the output circuit of the current-dividing circuit $S_2$, this will not affect the operation of the current stabilizer.

Equal variations of the absolute values of the collector currents of transistors $T_7$ and $T_8$ are corrected automatically by an opposite variation of the currents from the current-dividing circuit $S_1$, provided that the ratio between the collector currents of the transistors $T_7$ and $T_8$ remains the same.

The currents supplied by the current-supply circuits need not be small relative to the stabilized currents in the input and output circuits of the current-dividing circuit $S_2$. The currents supplied by the current-supply circuits must only be smaller than the stabilized current. The currents from the current-supply circuits are each, for example, 2.5 $\mu$A if the stabilized current in each of the circuits is 10 $\mu$A.

The arrangement has the advantage that the total current consumed by the current-stabilizing arrangement between the terminals $+V_B$ and $-V_B$ is stabilized. A stabilized current can also be taken from the collector of a transistor whose base-emitter path is arranged in parallel with the base-emitter path of transistor $T_4$. The arrangement can be operated with very low supply voltages because a starting current is obtained through resistor $R_3$ for supply voltages higher than substantially two base-emitter voltages, that is, for voltages higher than approximately 1.2 V.

In the present embodiment the stabilized current in the input circuit of the current-dividing circuit $S_2$ is equal to the stabilized current in the output circuit of the current-dividing circuit $S_2$. However, these currents may alternatively be unequal. As is known, the emitter areas of transistors $T_4$ and $T_5$ may then be equal. The ratio between the currents is then determined by the ratio between the emitter areas of transistors $T_1$ and $T_2$ of the current-dividing circuit $S_1$. In order to ensure that the starting currents from the first and the second current-supply circuit do not affect the operation of the current stabilizer the ratio between the starting currents must be equal to the ratio between the currents from the current-dividing circuit $S_1$. The ratio between the emitter areas of transistor $T_7$ and transistor $T_8$ must therefore be equal to the ratio between the emitter areas of transistors $T_2$ and $T_1$. However, alternatively the ratio between the emitter areas of transistors $T_4$ and $T_5$ of the current-dividing circuit $S_2$ in the present embodiment may be different from unity.

Figure 3:
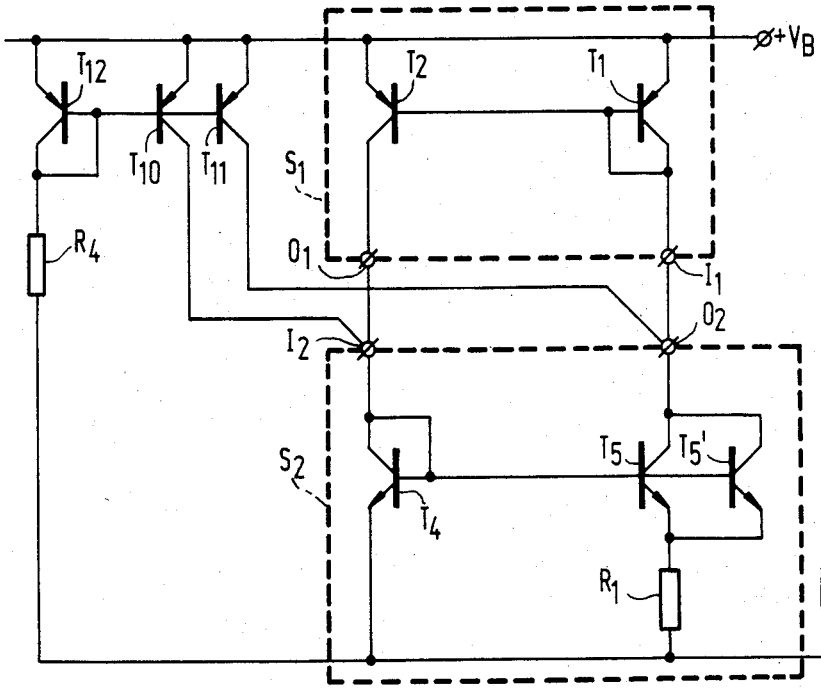
FIG. 3 shows a second current-stabilizing arrangement in accordance with the invention.

A second version of a current-stabilizing arrangement will be described with reference to FIG. 3. This arrangement comprises a first current-dividing circuit $S_1$, which is identical to the current-dividing circuit $S_1$ shown in FIG. 2, and a second current-dividing circuit $S_2$, which is identical to the current-dividing circuit $S_2$ shown in FIG. 2. The first current-supply circuit, which supplies a starting current to the input circuit of the current-dividing circuit $S_2$, comprises a transistor $T_{10}$ whose emitter is connected to the positive power-supply terminal $+V_B$ and whose base is at a reference voltage. The second current-supply circuit, which supplies a starting current to the output circuit of the current-dividing circuit $S_2$, comprises a transistor $T_{11}$ whose emitter is connected to the positive power-supply terminal $+V_B$ and whose base is connected to the base of transistor $T_{10}$ and consequently is also at the reference voltage. Transistors $T_{10}$ and $T_{11}$ have equal emitter areas, so that the starting currents from the first and the second current-supply circuit are equal. Suitably, transistors $T_{10}$ and $T_{11}$ may be combined as one lateral transistor with a double collector. In the case of variations of the total collector current the two starting currents will vary to the same extent. The reference voltage on the bases of transistors $T_{10}$ and $T_{11}$ is generated by a transistor $T_{12}$ which is connected as a diode and which, in series with a resistor $R_4$, is arranged between the positive power-supply terminal $+V_B$ and the negative power-supply terminal $-V_B$. A stabilized current is available on the collector of a transistor (not shown) whose base-emitter path is arranged in parallel with that of transistor $T_4$. If the negative power-supply terminal to which the resistor $R_4$ is connected is uncoupled from the negative supply terminal $-V_B$ to which the input circuit and the output circuit of the current-dividing circuit $S_4$ are connected, a stabilized current can be taken from this negative power-supply terminal $-V_B$.

It will be evident that the invention is not limited to the two embodiments shown in the Figures. The two current-dividing circuits may be of any desired known circuit design. For example, the current ratio in the two current paths may alternatively be defined by means of resistors in the emitter lines of transistors $T_1$ and $T_2$. Moreover, it is obvious that the conductivity types of the transistors in the two current-dividing circuits may be interchanged, so that the current-dividing circuit with npn transistors determines the current ratio and the current-dividing circuit with pnp transistors defines the absolute values of these currents in the two current paths.

Further, it will be evident that the current sources for the supply of the starting currents may be of any desired known circuit design.

What is claimed is:

1. A current stabilizing arrangement comprising a first and a second current path between a first and a second common terminal, a first current-dividing circuit comprising transistors of a first conductivity type and having an input circuit with a low input impedance and an output circuit with a high output impedance, and a second current-dividing circuit comprising transistors of a second conductivity type and also having an input circuit with a low input impedance and an output circuit with a high output impedance, the first current-dividing circuit defining the ratio between currents flowing in the two current paths and the second current-dividing circuit defining the absolute values of the currents flowing in the two current paths and having a semiconductor junction connected in parallel with a series arrangement of a semiconductor junction and a first resistor, which current-stabilizing arrangement also comprises means for starting the current-stabilizing arrangement, characterized in that the means comprises a first current-supply circuit which supplies a current to the input circuit of the second current-dividing circuit and a second current-supply circuit which supplies a current to the output circuit of the second current-dividing circuit, the currents supplied by the first and the second current-supply circuit having a ratio which is equal to the ratio between the currents in the two current paths as defined by the first current-dividing circuit.

2. A current-stabilizing arrangement as claimed in claim 1, characterized in that the first current-supply circuit comprises a series arrangement of a transistor connected as a diode and a resistor, the resistor being coupled to the input circuit of the second current-dividing circuit, and the second current supply circuit comprises a transistor whose base is coupled to the base of the transistor of the first current-supply circuit.

3. A current-stabilizing arrangement as claimed in claim 1, characterized in that the first and the second current-supply circuit each comprise a transistor, which transistors have commoned bases which carry a reference voltage.

4. A current-stabilizing arrangement as claimed in claim 3, characterized in that the transistors of the first and the second current-supply circuit comprise a single transistor having a double collector.

* * * * *

UNITED STATES PATENT AND TRADEMARK OFFICE

CERTIFICATE OF CORRECTION

PATENT NO. : 4,567,426

DATED : January 28, 1986

INVENTOR(S) : RUDY J. VAN DE PLASSCHE ET AL

It is certified that error appears in the above-identified patent and that said Letters Patent is hereby corrected as shown below:

IN THE ABSTRACT: line 1, after "are" insert --arranged--.

line 8, after "stabilizing" insert --arrangement--.

Signed and Sealed this

Thirtieth Day of December, 1986

*Attest:*

DONALD J. QUIGG

*Attesting Officer*

*Commissioner of Patents and Trademarks*